US009470411B1

(12) United States Patent
Ramsey

(10) Patent No.: US 9,470,411 B1
(45) Date of Patent: Oct. 18, 2016

(54) ILLUMINATING UNDERGARMENT AND METHOD OF USE

(71) Applicant: Jami Rose Ramsey, Land O'Lakes, FL (US)

(72) Inventor: Jami Rose Ramsey, Land O'Lakes, FL (US)

( * ) Notice: Subject to any disclaimer, the term of this patent is extended or adjusted under 35 U.S.C. 154(b) by 176 days.

(21) Appl. No.: 14/276,016

(22) Filed: May 13, 2014

Related U.S. Application Data

(60) Provisional application No. 61/827,589, filed on May 25, 2013.

(51) Int. Cl.
*F21V 21/08* (2006.01)
*F21V 33/00* (2006.01)
*A41B 9/00* (2006.01)

(52) U.S. Cl.
CPC ..... *F21V 33/0008* (2013.01); *A41B 9/00* (2013.01)

(58) Field of Classification Search
CPC ..... F21V 33/0008; A41B 9/00; A41B 9/001; A41B 9/002; A41B 9/004; A41B 9/005; A41B 9/007; A41B 9/008; A41B 9/02; A41B 9/023; A41B 9/026; A41B 9/04; A41B 9/06; A41B 9/08; A41B 9/10; A41B 9/12; A41B 9/14; A41B 9/16; A41B 2400/00
USPC ..... 362/103, 108, 457–458
See application file for complete search history.

(56) References Cited

U.S. PATENT DOCUMENTS

| | | | |
|---|---|---|---|
| 4,164,008 | A | 8/1979 | Miller et al. |
| 4,480,293 | A | 10/1984 | Wells |
| 4,570,206 | A | 2/1986 | Deutsch |
| 4,709,307 | A | 11/1987 | Branom |
| 5,113,325 | A | 5/1992 | Eisenbraun |
| 5,278,734 | A | 1/1994 | Ferber |
| 5,440,461 | A | 8/1995 | Nadel et al. |
| 7,878,675 | B2 | 2/2011 | Finn |
| 2003/0213044 | A1 | 11/2003 | Wilkinson et al. |
| 2010/0251453 | A1 | 10/2010 | Chen |

*Primary Examiner* — Jason Moon Han
(74) *Attorney, Agent, or Firm* — Allen D. Hertz, P.A.; Allen D. Hertz

(57) ABSTRACT

An illuminating undergarment carries a series of illuminating devices for emitting light and presenting a glow from underneath an outer garment. The undergarment can be tailored in any suitable form factor, such as a slip for placement under a skirt or skirt portion of a dress or other form factors for use under dresses, blouses, pants, etc. The undergarment comprises a series of illuminating device retention members affixed to a surface of the undergarment body. Examples of retention members include a pocket and a retention strap. The illuminating devices are removably attached to the undergarment by the retention members. The illuminating devices can be arranged in a random pattern, in a pattern representing an object, in a pattern representing text, etc. and any combination thereof. The illuminating devices are powered by a portable power supply and can be controlled by a circuit and/or a switch.

20 Claims, 9 Drawing Sheets

ILLUMINATING UNDERGARMENT AND METHOD OF USE

CROSS REFERENCE TO RELATED APPLICATIONS

This application is a Non-Provisional Utility Application, which claims the benefit of U.S. Provisional Patent Application Ser. No. 61/827,589, filed on May 25, 2013, which is incorporated by reference herein in its entirety.

FIELD OF THE INVENTION

The present disclosure generally relates to an undergarment. More particularly, the present disclosure relates to an undergarment comprising a plurality of illuminating elements, preferably having each placed illuminating element inserted within a pocket to illuminate a dress, skirt, and the like.

BACKGROUND OF THE INVENTION

Individuals strive to present themselves in a particular image. The person's image can vary in many ways, including a memorable tone, a concealing tone, a unique tone, a dressy tone, a casual tone, a sexy tone, and the like. Various components contribute to the person's image, including makeup, hairstyle, attire, shoes, accessories, and the like.

Certain individuals attending certain events strive to make a memorable impression on others. This can include other attendees, the press, and the like. The uniqueness can be for any of a variety of reasons, including special occasions (weddings, prom, homecoming, other school event, sweet sixteen parties, quinceañera, christenings, bar mitzvah, bat mitzvah, fundraisers, awards banquets, concerts, plays, etc.), pageants, evening outings (such dancing, clubbing, concerts, etc.), and the like. Individuals that would desire to make memorable impressions can include a modern bride; a bridesmaid/bridal party; a celebrity attending an event, such as an awards ceremony; a singer or entertainer attending an event, such as the Grammys; a performer performing in a play, a theater event, a street performer, and the like; an actor or actress performing in a recorded production, such as television program, a movie, and the like; a musician performing at a gig; athletic performers, such as ice skaters; ballerinas or other dancers at a recital; cheerleaders performing at an event; and any other suitable event where the individual desires to become a key center of attention.

One manner for making a memorable impression is where an individual wears a dress or other apparel that accent or elude to certain physical properties, including legs, hips, breast line, cleavage, and the like, wherein the accents are directed towards a sexually memorable impression. This can include an outline of the garment, cutouts within the garment, slits within the garment, and the like. Portions of the garment can be open, exposing the individual's skin, utilize a nude backing material, and the like to present the desired perception.

Another manner for making a memorable impression includes a dress or other apparel having accents or other features that are unique. One example of an instance was a dress shaped as a swan. Another example was a garment tailored using fabric having a unique print. Yet another example was a jacket worn backwards.

Lights have been known to be added to various garments, whereby the lights are permanently attached to the inner surface of the fabric of the garment. This configuration limits the application of the under-lighting to the respective garment. The illuminating elements are attached to the interior of the garment in a fixed arrangement, thus introducing another limitation.

What is desired is a garment accessory enabling the wearer with the ability to illuminate any of a variety of garments. An additional benefit would be an apparatus and associated method of use enabling a user to customize an arrangement of a plurality of lights placed upon an undergarment into any specific pattern to illuminate an outer garment.

SUMMARY OF THE INVENTION

The basic inventive concept provides an undergarment having a series of illuminating device retention members attached to an exterior surface thereof.

A first aspect of the present invention provides an illuminating undergarment comprising:

an undergarment body tailored of a fabric, the undergarment body having an undergarment material extending between an upper opening, and at least one lower opening, an orientation of the undergarment body defining an exterior surface and an interior surface;

a plurality of illuminating device attachment elements affixed to the undergarment body exterior surface;

at least one illuminating assembly comprising at least one illuminating element in electrical communication with a portable power supply, wherein the at least one illuminating assembly is removably attached to the undergarment body exterior surface by a respective illuminating device attachment element of the plurality of illuminating device attachment elements.

In a second aspect of the present invention, the upper opening defines a waistline, the at least one lower opening defines a hemline, and the undergarment material is shaped forming a skirt undergarment.

In another aspect, the upper opening defines a neckline, the at least one lower opening defines a waistline, and the undergarment material is shaped forming a blouse undergarment.

In yet another aspect, the upper opening defines one of a neckline or bust line, the at least one lower opening defines a hemline, and the undergarment material is shaped forming a dress undergarment.

In yet another aspect, the upper opening defines one of a waistline, the at least one lower opening defines a pair of hemlines, and the undergarment material is shaped forming a pant undergarment.

In yet another aspect, the garment can be shaped as a wrap, wherein the upper opening and lower opening are respective edges of the undergarment body.

In yet another aspect, the illuminating device attachment elements are provided in a form factor of a pocket.

In yet another aspect, the illuminating device attachment elements are provided in a form retention strap.

In yet another aspect, the retention straps further comprise a snap for removably affixing the illuminating assembly to the undergarment body exterior surface.

In yet another aspect, the retention straps further comprise a spiral shaped retention element for retaining the illuminating assembly to the undergarment body exterior surface. The spiral shaped retention element is looped about an electrically conductive element or wire of the illuminating assembly.

In yet another aspect, the illuminating assembly is fabricated including a light emitting diode (LED) strip comprising a plurality of LED's. Although the exemplary embodiment of this aspect utilizes an LED strip, is understood that any plurality of illuminating devices can be used.

In another aspect, the illuminating devices can be fabricated using one or more light emitting diodes (LEDs), incandescent bulbs, florescent bulbs, electroluminescent subassemblies, and the like. The illuminating devices can be designed to emit different colors based upon changes of an input signal, such as multicolored LED's.

In another aspect, the illuminating system can further include fiber optics for transferring emitted light from a light source to a desired location for emission of the light.

In yet another aspect, the illuminating assembly includes an illuminating device housing, wherein the illuminating device housing carries the illuminating element. The illuminating assembly further comprises an electrical circuit communicating electrical power from the portable power supply to the illuminating device.

In yet another aspect, the illuminating assembly includes an illuminating device housing, wherein the illuminating device housing carries the portable power supply.

In yet another aspect, the illuminating electrical circuit further comprises an illumination switch, wherein the illumination switch provides operational control of the illuminating element.

In yet another aspect, the illuminating electrical circuit provides operational control each of the illuminating elements in any of the following modes:

a. a Continuous, solid light emission, b. a Flashing light emission, c. a Sequential light emission, and d. a Color changing light emission.

In yet another aspect, the illumination switch provides an operational interface with the illuminating electrical circuit to select a desired illuminating mode of operation.

In yet another aspect, the illuminating assembly includes an illuminating element assembly electrical conductor carrying a plurality of illuminating elements thereon, the illuminating element assembly electrical conductor further providing electrical communication between each of the plurality of illuminating elements and the portable power supply.

In yet another aspect, the illuminating element retention elements are attached to an exterior surface of the undergarment material in a random arrangement.

In yet another aspect, the illuminating element retention elements are attached to an exterior surface of the undergarment material in an array pattern arrangement. The array pattern can be a horizontal/vertical grid, a diagonally arranged array, and the like.

In yet another aspect, illuminating undergarment can include a thermal barrier to prevent transfer of heat from the illuminating elements to the wearer. The illuminating undergarment may include a lining material to provide a function of the thermal barrier; the undergarment material may be of a thermally absorbing or thermally reflective material, and the like.

In yet another aspect, the undergarment and/or illuminating elements can be coordinated to the outer garment by shape, style, color, material, and the like.

In yet another aspect, the undergarment and/or illuminating elements can be designed or tailored for a specific event, holiday, and the like.

A second embodiment of the present invention provides a method of illuminating a garment, the method comprising steps of:

obtaining an illuminating undergarment, the illuminating undergarment comprising:

an undergarment body tailored of a fabric, the undergarment body having an undergarment material extending between an upper opening, and at least one lower opening, an orientation of the undergarment body defining an exterior surface and an interior surface, and a plurality of illuminating device attachment elements affixed to the undergarment body exterior surface;

obtaining at least one illuminating assembly comprising:

at least one illuminating element in electrical communication with a portable power supply;

attaching said at least one illuminating assembly to the undergarment body using a respective illuminating device attachment element of the plurality of illuminating device attachment elements;

illuminating at least a portion of the at least one illuminating element;

placing the illuminating undergarment on the wearer;

placing an outer garment on the wearer, wherein the outer garment covers the illuminating undergarment and the emitted light from each illuminated illuminating element is visible through fabric of the outer garment.

In another aspect, the method further comprises a step of attaching each of a plurality of illuminating elements to the respective illuminating device attachment elements in a pattern.

In yet another aspect, the method further comprises a step of attaching each of a plurality of illuminating elements to the respective illuminating device attachment elements in a pattern, wherein the pattern presents an image of at least one object.

In yet another aspect, the method further comprises a step of attaching each of a plurality of illuminating elements to the respective illuminating device attachment elements in a pattern, wherein the pattern presents an image of text.

In yet another aspect, the method further comprises a step of attaching each of a plurality of illuminating elements to the respective illuminating device attachment elements in a pattern, wherein the pattern presents an image of a combination of text and at least one object.

These and other advantages of the invention will be further understood and appreciated by those skilled in the art by reference to the following written specification, claims and appended drawings.

BRIEF DESCRIPTION OF THE DRAWINGS

The invention will now be described, by way of example, with reference to the accompanying drawings, where like numerals denote like elements and in which.

Like reference numerals refer to like parts throughout the various views of the drawings.

DETAILED DESCRIPTION OF THE INVENTION

Figure 1:
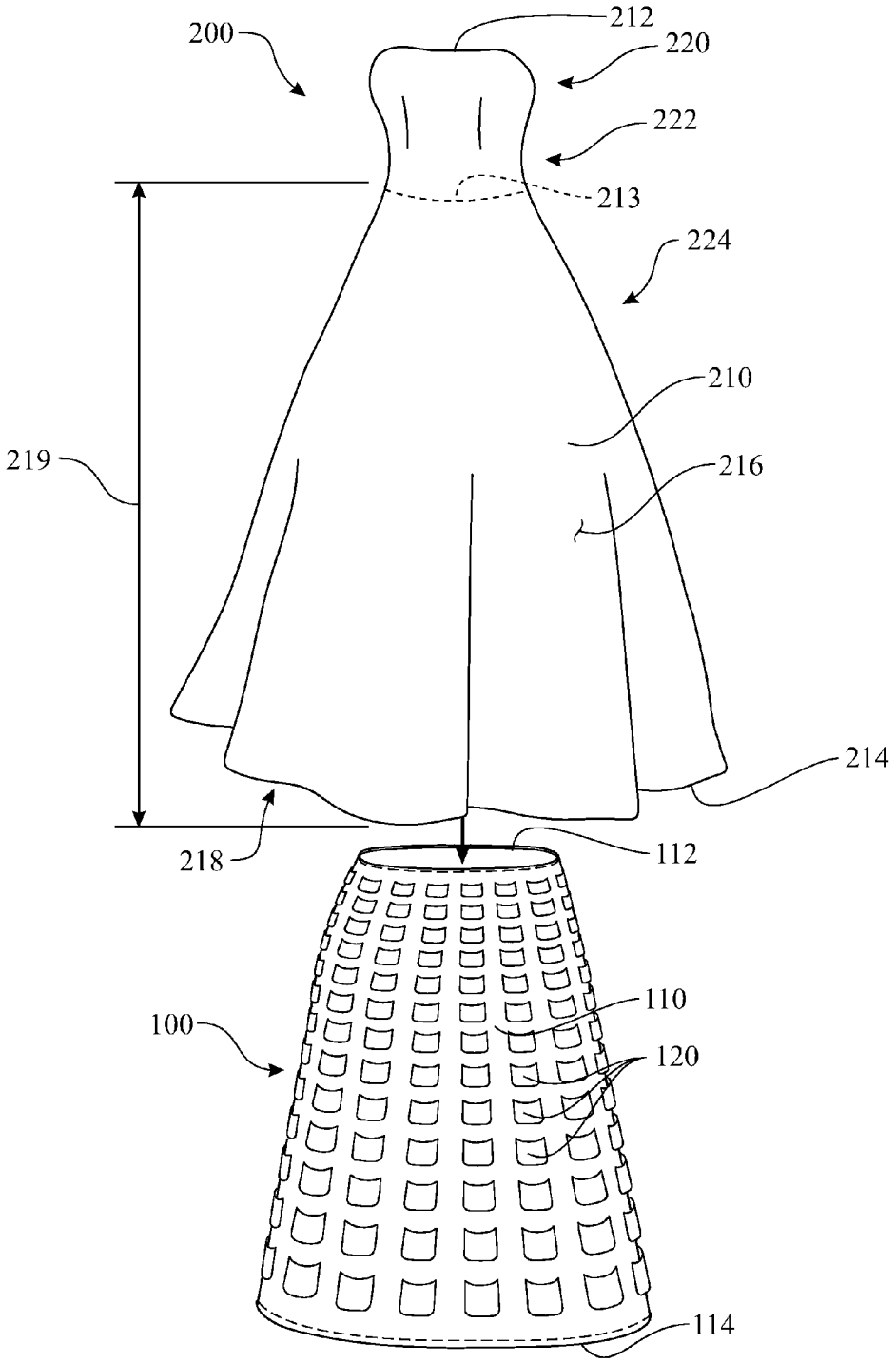
FIG. 1 presents a perspective, partially exploded assembly view of an exemplary illuminating undergarment being fitted beneath an outer garment in accordance with an exemplary embodiment of the present invention.

The following detailed description is merely exemplary in nature and is not intended to limit the described embodiments or the application and uses of the described embodiments. As used herein, the word "exemplary" or "illustrative" means "serving as an example, instance, or illustration." Any implementation described herein as "exemplary" or "illustrative" is not necessarily to be construed as preferred or advantageous over other implementations. All of the implementations described below are exemplary implementations provided to enable persons skilled in the art to make or use the embodiments of the disclosure and are not intended to limit the scope of the disclosure, which is defined by the claims. For purposes of description herein, the terms "upper", "lower", "left", "rear", "right", "front", "vertical", "horizontal", and derivatives thereof shall relate to the invention as oriented in FIG. 1. Furthermore, there is no intention to be bound by any expressed or implied theory presented in the preceding technical field, background, brief summary or the following detailed description. It is also to be understood that the specific devices and processes illustrated in the attached drawings, and described in the following specification, are simply exemplary embodiments of the inventive concepts defined in the appended claims. Hence, specific dimensions and other physical characteristics relating to the embodiments disclosed herein are not to be considered as limiting, unless the claims expressly state otherwise.

A first exemplary illuminating undergarment 100 is described in the illustrations presented in FIGS. 1 through 5. The illuminating undergarment 100 provides a wearer 299 with the ability to illuminate a desired and suitable outer garment 200. The exemplary outer garment 200 is illustrated having a form factor of a dress or gown, comprising a bodice portion 220, a midriff portion 222, and a skirt portion 224. The outer garment 200 is tailored using any suitable garment material 210. The surfaces of the outer garment 200 can be referred to as an exposed or outer garment surface 216 and a concealed or inner garment surface 218. Other features of the outer garment 200 include an upper opening or a neckline 212 and a lower opening or a hemline 214. One dimension of note is a garment skirt length 219, wherein the garment skirt length 219 extends from a waistline 213 to the hemline 214.

Figure 3:
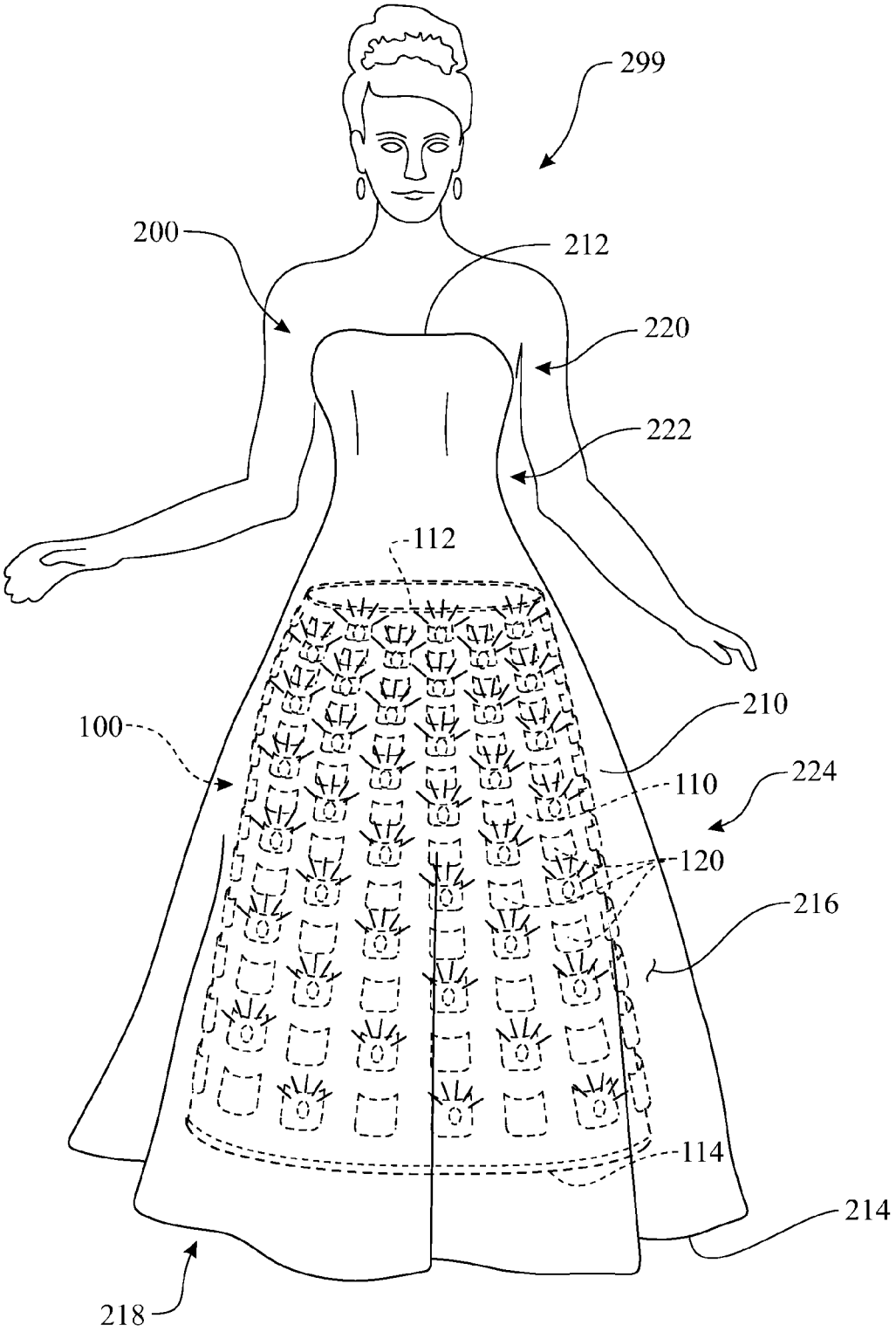
FIG. 3 presents a perspective view of the exemplary illuminating undergarment being worn beneath the outer garment, as originally introduced in FIG. 1, to exemplify an illuminating affect in a condition where the illuminating devices are operational and emitting light.

The illuminating undergarment 100 is worn underneath the outer garment 200. The illuminating undergarment 100 includes a plurality of illuminating device assemblies 130. When at least a portion of the plurality of illuminating device assemblies 130 are illuminated, the illuminated illuminating device assemblies 130 of the illuminating undergarment 100 generates a glow from within the outer garment 200, as illustrated in FIG. 3.

Figure 2:
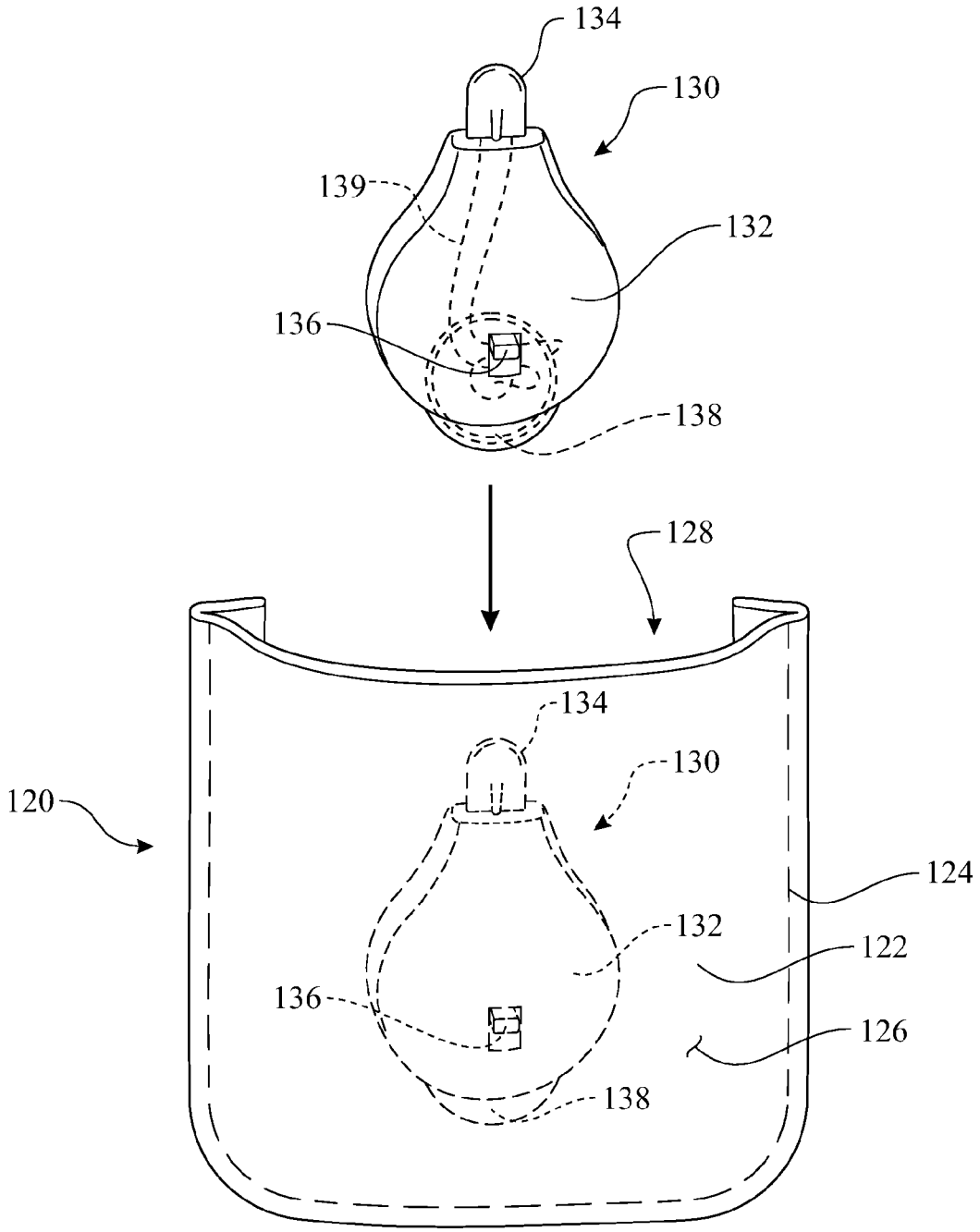
FIG. 2 presents a perspective view of an exemplary illuminating device receiving pocket having an exemplary illuminating device assembly being inserted therein.
Figure 4:
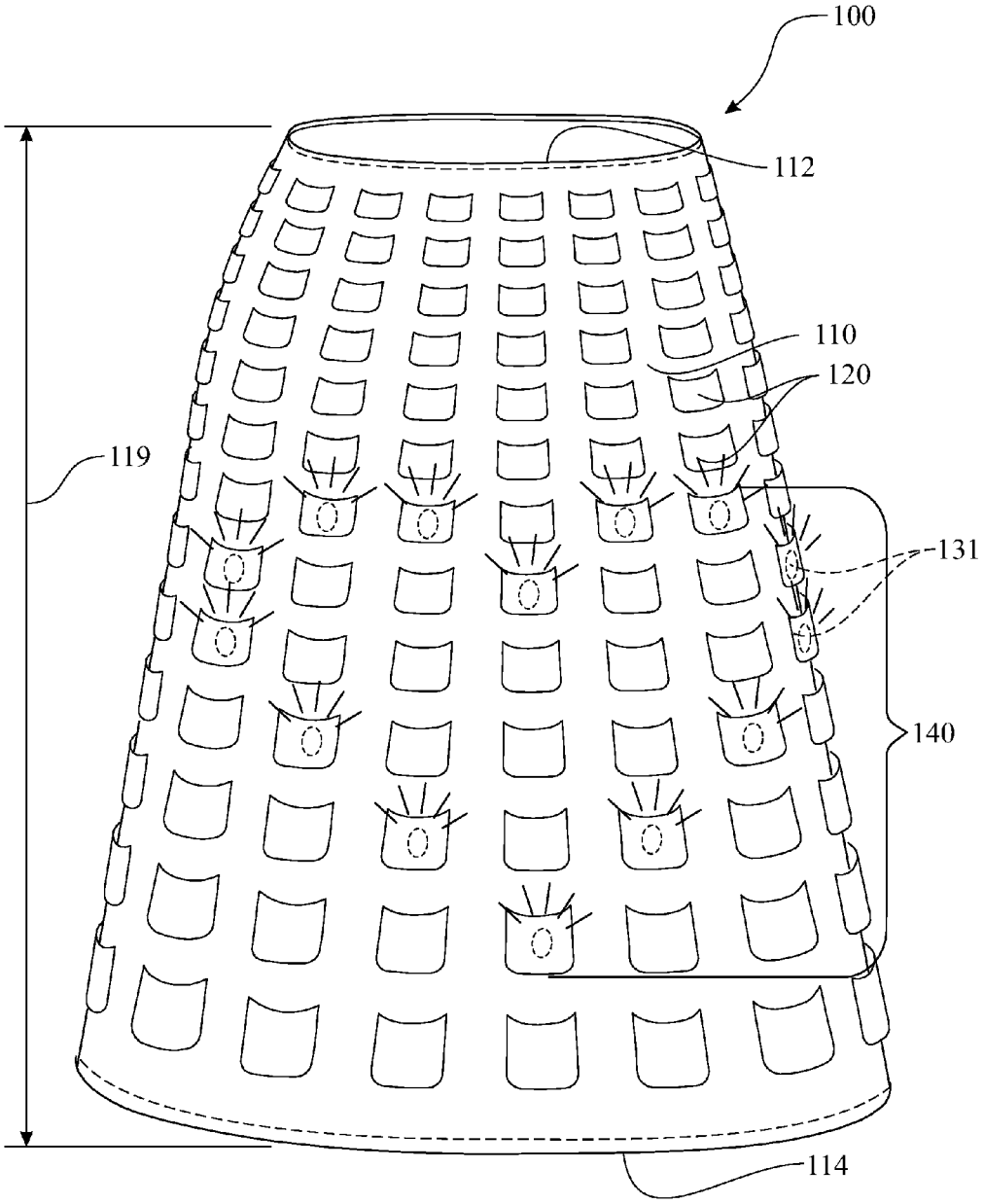
FIG. 4 presents a magnified perspective view of the exemplary illuminating undergarment as originally introduced in FIG. 1, the illustration demonstrating a method of arranging the plurality of illuminating devices in a pattern presenting an image representative of an object.

The exemplary illuminating undergarment 100 is tailored of an undergarment material 110 in a form factor of a slip, a petticoat, an underskirt, and the like. The undergarment material 110 is tailored into a tubular shape extending between an undergarment waistband 112 and an undergarment hem 114. The term tubular refers to a shape comprising an annular first end (in this case the undergarment waistband 112), an annular second end (in this case the undergarment hem 114), and material spanning between circumferential edges of the two annular ends 112, 114. It is understood that the shape can be substantially cylindrical, of a frustum, and the like. The illuminating undergarment 100 can be formed in any suitable shape, including a flaring shape (which may include crinoline), a fitted underskirt, long (for formal wear); short for minidresses, cocktail dresses, miniskirts; ball gown styles, straight for fitted dresses; mermaid style; unique styles associated with costumes, custom garments, and the like. The elongated distance spanning between the undergarment waistband 112 and the undergarment hem 114 of the illuminating undergarment 100 is referred to as an undergarment length 119 (FIG. 4). The undergarment length 119 can be any length suitable for placement underneath a desired garment. The undergarment waistband 112 can include common features associated with any waistline, including a waistband, an elastic insert, one or more fasteners (such as buttons, snaps, hook and eyes, and the like), a waistband tie, and the like. The waistband region can additionally include a vertical zipper to increase the diameter of the waistband to help the wearer 299 pull the illuminating undergarment 100 over their hips. The illuminating undergarment 100 includes a plurality of illuminating device receiving pockets 120. Each illuminating device receiving pocket 120 is fabricated of a section of pocket material 122. The pocket material 122 can be selected of any light transmissive material. The pocket material 122 for each illuminating device receiving pocket 120 is formed in any suitable shape, with the preferred shape being a rounded cornered rectangle as illustrated in FIG. 2. The edges of the material are preferably folded over as shown to provide a finished edge. The series of illuminating device receiving pockets 120 are affixed to the undergarment material 110 by any suitable process. The most common attachment process would be the use of stitching 124 about a portion of the peripheral edge of the pocket material 122, leaving an upper edge unattached. The stitching 124 and respective open upper edge creates a pocket interior 128 and respective access thereto. The series of illuminating device receiving pockets 120 are affixed to an exterior surface of the undergarment material 110 in any desired arrangement. In one arrangement, the series of illuminating device receiving pockets 120 are arranged in any desired arrangement, including a random layout, a horizontal/vertical grid or array (as illustrated), a diagonally arranged array, and the like. It is also understood that the series of illuminating device receiving pockets 120 can be arranged in any suitable predetermined pattern or a random pattern. The pattern can be representative of a phrase, an image, and the like or any combination thereof.

The illuminating undergarment 100 includes a series of illuminating device assemblies 130. Each exemplary illuminating device assembly 130 includes an illuminating element 134 supported by an illuminating device housing 132. The illuminating undergarment 100 includes an illumination circuit 139 providing electrical communication between a portable power supply 138 (wherein the portable power supply can be any suitable electrical power source, including at least one battery, at least one capacitor, a solar panel, and the like) and the illuminating element 134. The illuminating device assembly 130 can include an illumination switch 136 providing a simplistic device for controlling operation of the illuminating element 134. The portable power supply 138 can be integrated into the illuminating device housing 132 or independent thereof. The illumination switch 136 can be manually operated, motion operated, wirelessly operated, a combination thereof, and the like. The illuminating element 134 can utilize light emitting diodes (LED's), incandescent bulbs, florescent bulbs, electroluminescent elements, and the like. The illuminating devices can be selected to emit a single color or a plurality of colors. The illuminating devices can be designed to emit different colors based upon changes of an input signal, such as multicolored LED's. The illuminating device assembly 130 can include a circuit 139 enabling the illuminating device assemblies 130 to emit a solid continuous light pattern, a flashing light pattern, a sequential light pattern, a color changing light pattern, and the like. It is understood that the illuminating device housing 132 can be designed in any form factor, size, and shape suitable for the desired application.

The wearer 299 (or other individual) determines the desired arrangement of placement of the illuminating device assemblies 130 within the illuminating undergarment 100. The illuminating device assemblies 130 can be arranged in a random pattern, as illustrated in FIG. 3; a pattern representing an object or geometric design, and the like, as illustrated in FIG. 4; a pattern representing text or a combination of text and an object or geometric design, and the like, as illustrated in FIG. 5; and the like.

The series of illuminating device assemblies 130 can be arranged in a pattern representing an object or geometric design, and the like, as illustrated in FIG. 4. The exemplary arrangement presents an illuminated image 140 in a pattern of a heart.

Figure 5:
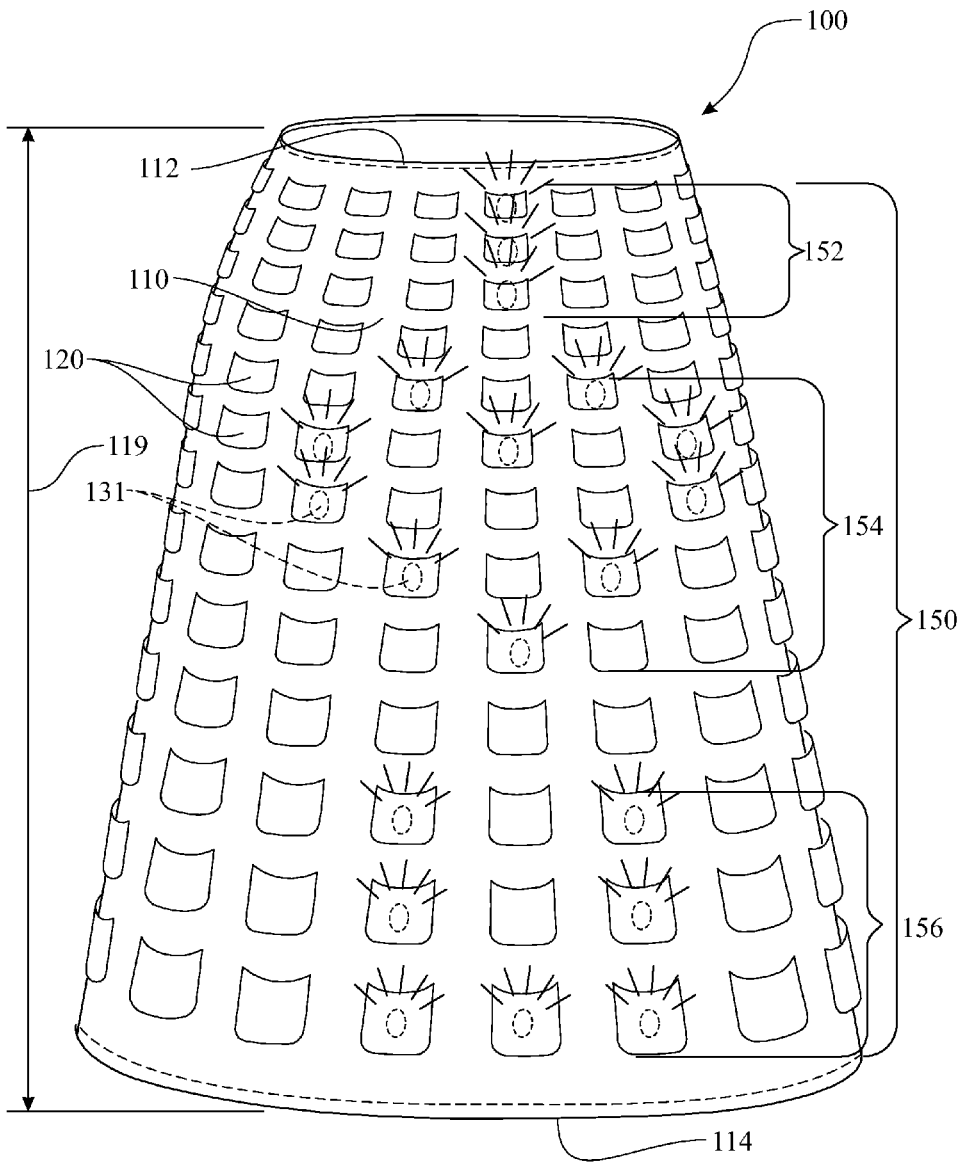
FIG. 5 presents a magnified perspective view of the exemplary illuminating undergarment as originally introduced in FIG. 1, the illustration demonstrating a method of arranging the illuminating devices in a pattern presenting an image representative of a combination of an object and text.

The series of illuminating device assemblies 130 can be arranged in a pattern representing text or a combination of text and an object or geometric design, and the like, as illustrated in FIG. 5. The exemplary arrangement presents an illuminated message 150 in a pattern of a three segment message stating "I LOVE YOU". The first illuminated message segment 152 presents an illuminated image of an "I". The second illuminated message segment 154 presents an illuminated image of a "heart" representing "love". The third illuminated message segment 156 presents an illuminated image of a "U" representing "you". Collectively, the first illuminated message segment 152, second illuminated message segment 154, and third illuminated message segment 156 form the illuminated message 150. It is understood that the user can arrange the series of illuminating device assemblies 130 in any desired pattern. It is also understood that one illuminating device assembly 130 can be placed in every illuminating device receiving pockets 120, wherein only a portion of the illuminating device assemblies 130 are illuminated to create the desired pattern.

The illuminating undergarment 100 can include a thermally insulating feature to insulate the wearer 299 from any heat generated by the series of illuminating device assemblies 130. The thermally insulating feature can be the use of thermally insulating material for the undergarment material 110, including a thermally insulating material behind the undergarment material 110 when fabricating the illuminating undergarment 100, inserting a thermally insulating material within at least a portion of the illuminating device receiving pockets 120 of the series of illuminating device receiving pockets 120, and the like. The illuminating device assembly 130 would be placed external of the thermally insulating material.

Figure 6:
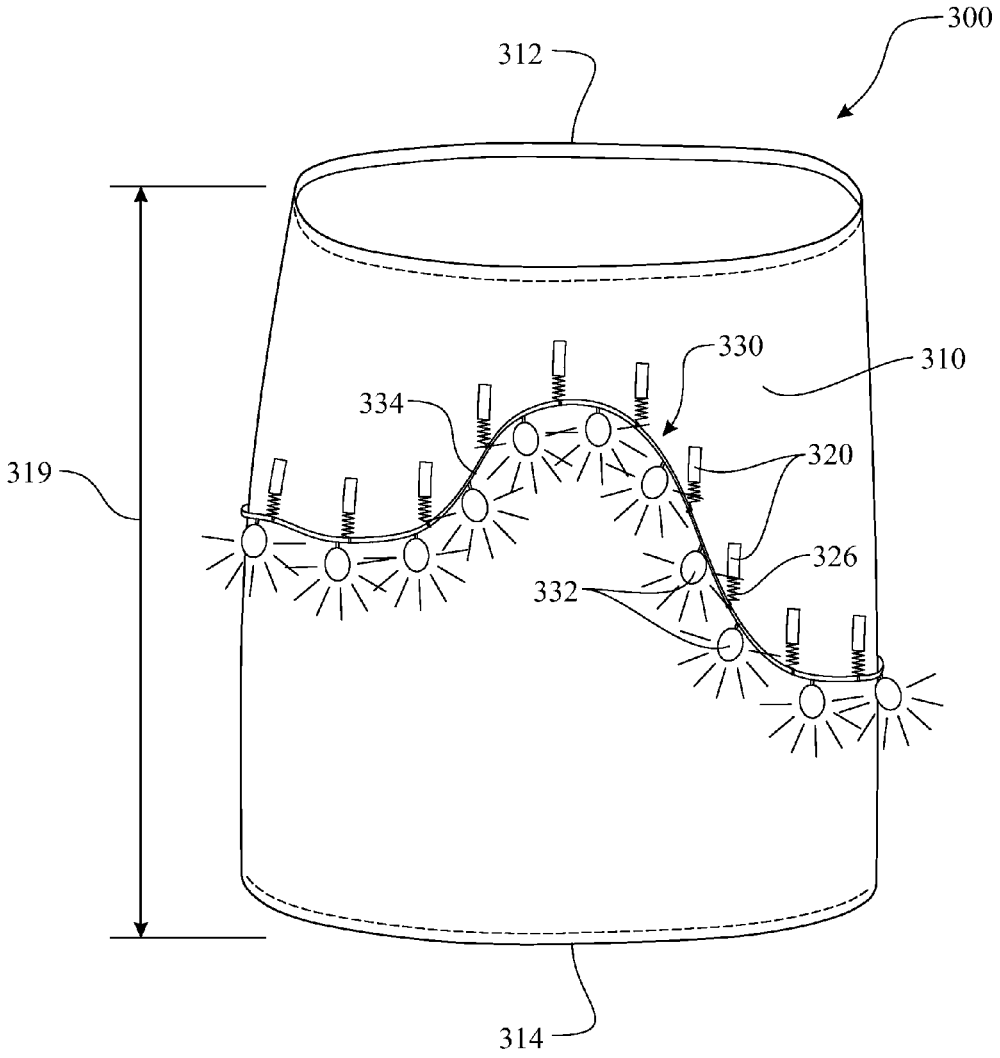
FIG. 6 presents a perspective view of an alterative exemplary embodiment of the illuminating undergarment, wherein the alterative illuminating undergarment temporarily assembles the plurality of illuminating devices to an outer surface of the undergarment material using a plurality of illuminating element retention assemblies or fasteners.

The first exemplary embodiment utilizes a series of illuminating device receiving pockets 120 for retaining the plurality of illuminating device assemblies 130. A second exemplary embodiment, referred to as an illuminating undergarment 300 and illustrated in FIG. 6, utilizes a plurality of illuminating element retention assemblies 320 for temporarily attaching one or more illuminating element assemblies 330 to an outer surface of an undergarment material 310. The illuminating undergarment 300 is fabricated in a manner similar to the illuminating undergarment 100, wherein like features of the illuminating undergarment 300 and the illuminating undergarment 100 are numbered the same except preceded by the numeral '3'. Each illuminating element retention assembly 320 includes an illuminating element retention element 326, wherein the illuminating element retention element 326 removeably secures the illuminating element assembly 330 to the undergarment material 310. The illuminating element retention element 326 can be provided as any suitable attachment element, including a spring, a flexible wire, a snap, a ribbon, and the like. In the second exemplary embodiment, the illuminating element assembly 330 is provided in a form factor having a series of illuminating elements 332 spatially arranged along a length of an illuminating element assembly electrical conductor 334. The illuminating element assembly electrical conductor 334 provides two functions to for the illuminating element assembly 330, the first being support of the illuminating elements 332 and the second being an electrical conduit between a portable power supply and each illuminating element 332. It is understood that illuminating element assembly 330 can be fabricated of any suitable multi-illuminating device configuration. This can include light emitting diode (LED) strips, ribbon lighting, and the like.

It is noted that the undergarment length 319 of the illuminating undergarment 300 is shorter than the undergarment length 119 of the illuminating undergarment 100. This illustrates the varied applications based upon differing desired lengths of the illuminating undergarment 100, 300.

Although the exemplary embodiments present different features, it is understood that features of each embodiment presented herein can be utilized with another embodiment. The illuminating undergarment 100, 300 can be manufactured having any of a variety of shapes and/or lengths. Additionally, the illuminating undergarment 100, 300 can include elements enabling the user to adjust the length accordingly. Although the illuminating device receiving pockets 120 and the illuminating element retention assemblies 320 present two embodiments for removably securing an illuminating device assembly 130, 330 to the illuminating undergarment 100, 300, it is understood that any suitable temporary retention device can be employed.

Although the exemplary embodiments of the illuminating undergarment 100, 300 are directed towards use under a skirt, it is understood that the same concept can be applied to a camisole, tank top, bra, undershirt, and the like for use in locations other than under a skirt portion of the outer garment.

Figure 7:
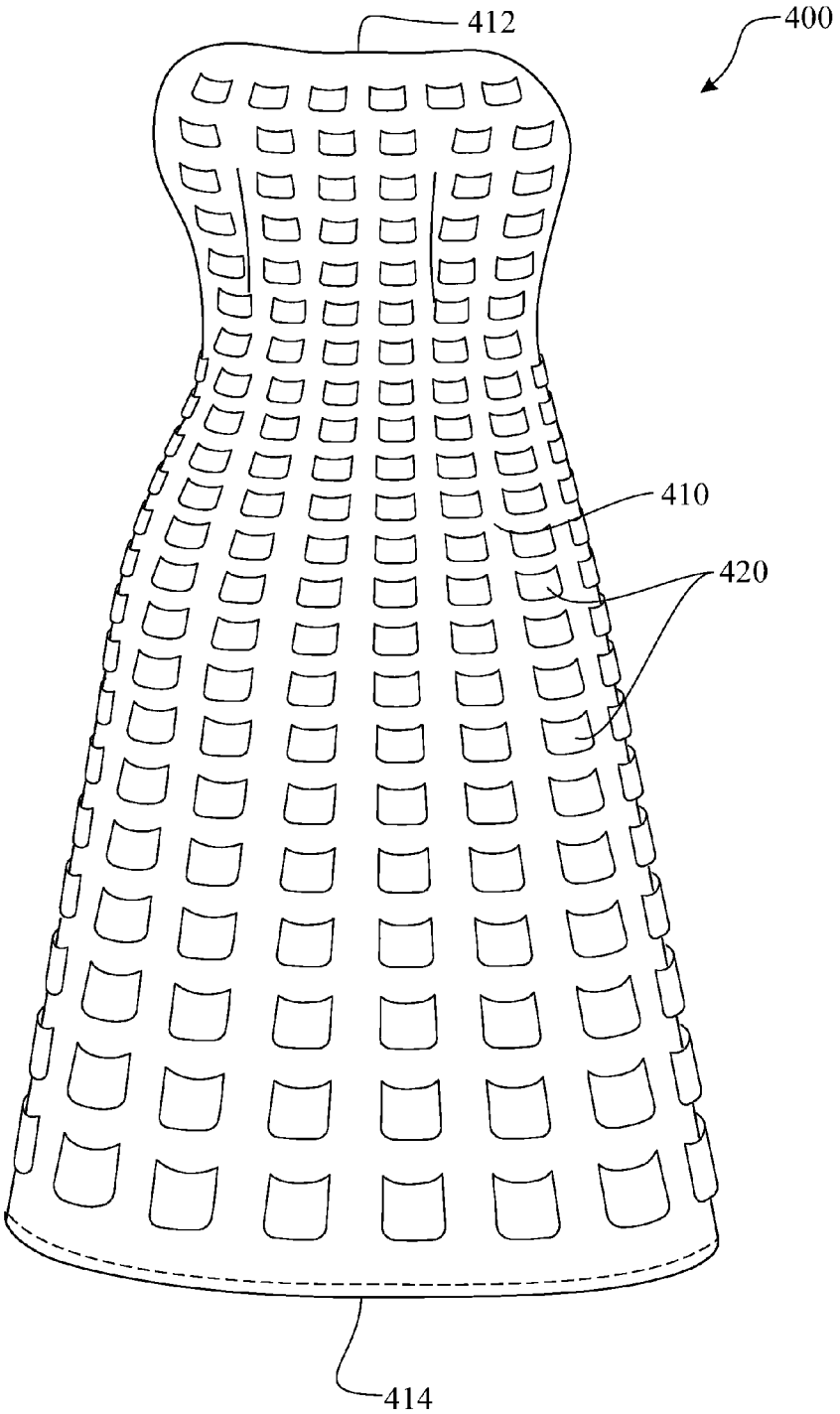
FIG. 7 presents a perspective view of another exemplary illuminating undergarment, wherein the illustrated embodiment is designed for use under a strapless dress.

As described above, the concept of the first exemplary embodiment of the undergarment 100 is designed for use as an underskirt. The concept of the undergarment 100 can be adapted for use under a dress 200 as shown in the exemplary embodiment presented in FIG. 7. The illuminating undergarment 400 is fabricated in a manner similar to the illuminating undergarment 100, wherein like features of the illuminating undergarment 400 and the illuminating undergarment 100 are numbered the same except preceded by the numeral '4'. For use as a dress undergarment 400, the upper opening 412 would define either a neckline or a bust line (as shown), the at least one lower opening 414 would define a hemline, and the undergarment body 410 would be shaped forming the dress undergarment 400.

Figure 8:
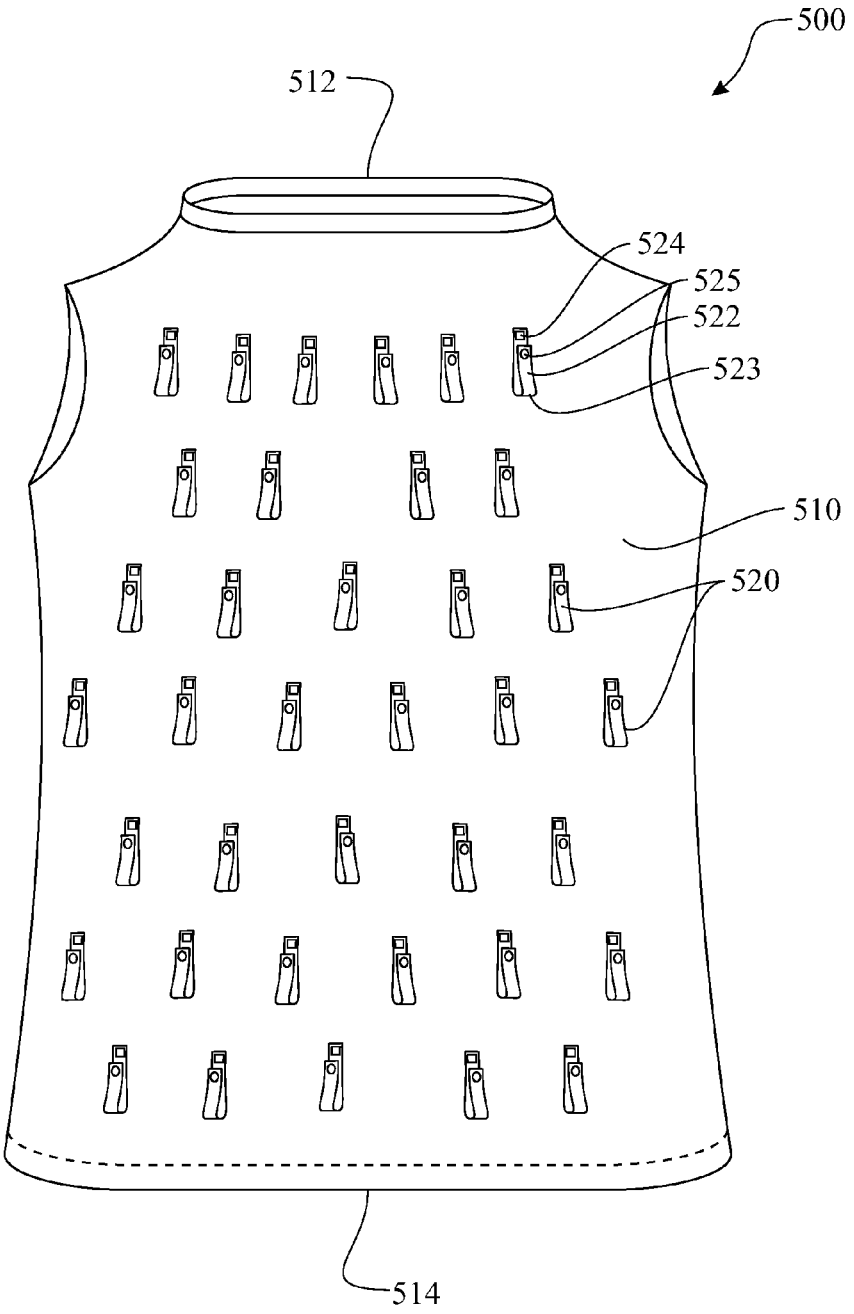
FIG. 8 presents a perspective view of yet another exemplary illuminating undergarment, wherein the illustrated embodiment is designed for use under a blouse.

Similarly, the concept of the undergarment 100 can be adapted for use under a top, such as a blouse, a camisole, a tank top, and the like as shown in the exemplary embodiment presented in FIG. 8. The illuminating undergarment 500 is fabricated in a manner similar to the illuminating undergarment 100, wherein like features of the illuminating undergarment 500 and the illuminating undergarment 100 are numbered the same except preceded by the numeral '5'. For use as a blouse undergarment 500, the upper opening 512 would define either a neckline (as shown) or a bust line, the at least one lower opening 514 would define a blouse hemline, and the undergarment body 510 would be shaped forming the blouse undergarment 500. The exemplary illuminating element retention assemblies 520 are formed comprising a strip of material 522 forming a loop 523 and a fastener 525. One end of the strip of material 522 is assembled to the undergarment material 510 by stitching 524 or any other suitable attachment method. A free portion of the fastener 525 is assembled to the opposite end of the strip of material 522, wherein when the free portion of the fastener 525 is temporarily engaging with a fixed portion of the fastener 525, the strip of material 522 forms the loop 523 for retaining the illuminating device assembly (not shown). The blouse undergarment 500 would preferably be fabricated of a stretch material, such as LYCRA™ to maintain a form fit upon the wearer 299.

Figure 9:
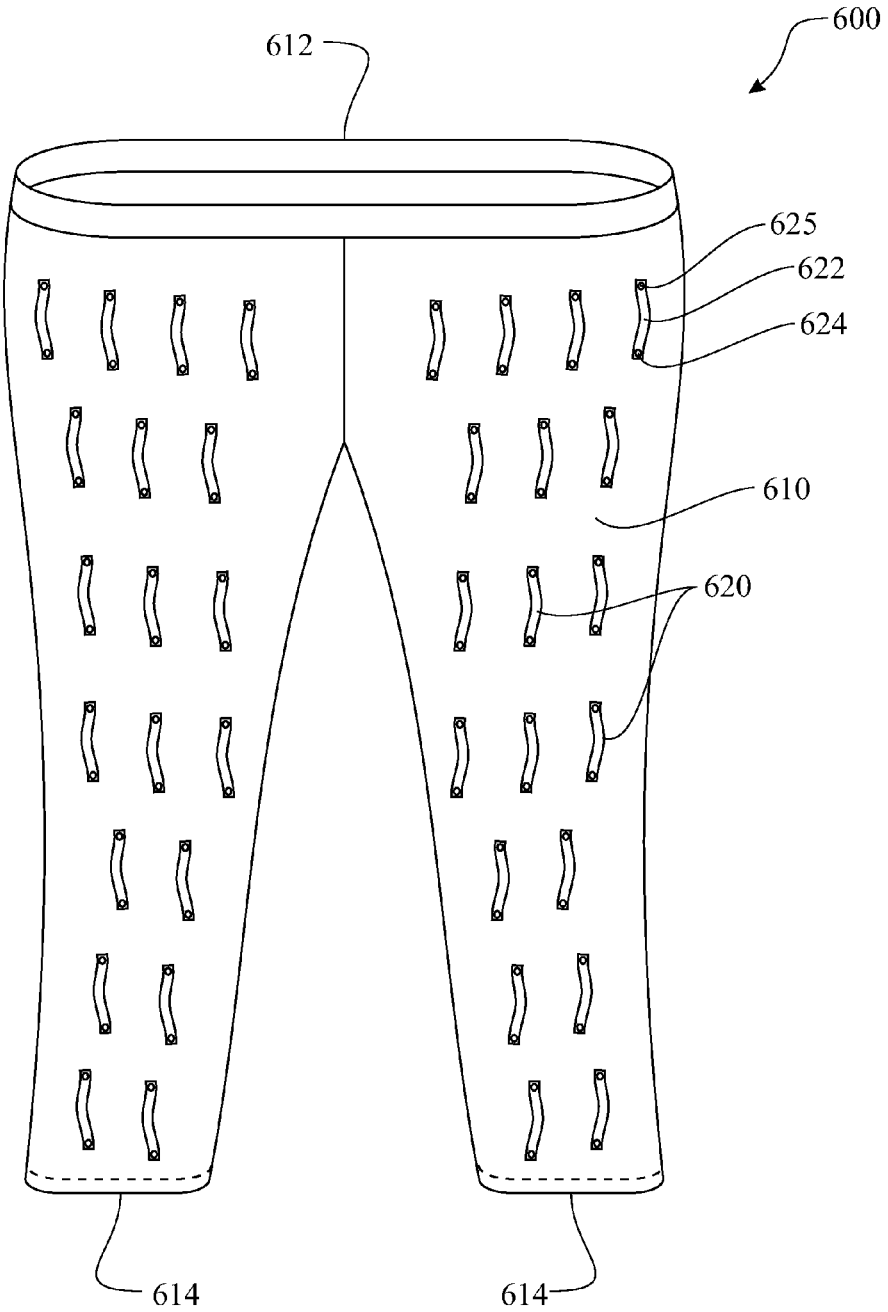
FIG. 9 presents a perspective view of yet another exemplary illuminating undergarment, wherein the illustrated embodiment is designed for use under one of pants, culottes, or shorts.

In yet another adaptation, the concept of the undergarment 100 can be adapted for use under pants, culottes, and/or shorts, and the like as shown in the exemplary embodiment presented in FIG. 9. The illuminating undergarment 600 is fabricated in a manner similar to the illuminating undergarment 100, wherein like features of the illuminating undergarment 600 and the illuminating undergarment 100 are numbered the same except preceded by the numeral '6'. For use as a pants undergarment 600, the upper opening 612 would define a waistline, the at least one lower opening 614 would be provided as a pair of lower openings 614, defining a pant hemline, and the undergarment body 610 would be shaped forming the pants undergarment 600. The exemplary illuminating element retention assemblies 620 are formed comprising a strip of material 622. One end of the strip of material 622 is assembled to the undergarment material 610 by stitching 624 or any other suitable attachment method. A fastener 625 is provided at a free end of the fastener 625. The fastener 625 is temporarily secured to a fastener counterpart that is assembled to the undergarment material 610. The illuminating device assembly (not shown) is retained by a free section of the strip of material 622 extending between the fixed end and the fastener end. The pants undergarment 600 would preferably be fabricated of a stretch material, such as LYCRA™ to maintain a form fit upon the wearer 299. Since many modifications, variations, and changes in detail can be made to the described preferred embodiments of the invention, it is intended that all matters in the foregoing description and shown in the accompanying drawings be interpreted as illustrative and not in a limiting sense.

Although the preferred embodiment locates the illuminating device receiving features 120 on an exterior surface of the illuminating undergarment 100, it is understood that the illuminating device receiving features 120 can be located on an interior surface of the illuminating undergarment 100 when the illuminating undergarment 100 is fabricated of a sheer, translucent, or transparent material.

It is understood that the illuminated light can be transferred from the light source to a desired illuminating location using one or more fiber optic strands.

In yet another embodiment, it is understood that the illumination source can be provided by a Chemiluminescence process. Each illuminating element would include compartments comprising chemicals, wherein when the chemicals are mixed together, the illuminating element emits light.

One noted benefit is the ability to wash the undergarment 100, as the electrical components are removeable. Another benefit would be freedom to introduce lighting to any garment tailored of a suitable material. This provides a merchant with a wider offering while stocking a small inventory of illuminating undergarments 100. The merchant can offer an illuminating undergarment 100 for use under any other suitable outer garment 200 to create a new illuminating effect. The illuminating undergarments 100 can be provided having illuminating device receiving features 120 in any of a variety of patterns, thus exponentially increasing the options and combinations for the consumer. The consumer can additionally wear the illuminating undergarment 100 with other suitable outer garments 200, thus further increasing the flexibility for use. The end result is a multi-function device that provides an affordable and adapting solution for the consumer.

Thus, the scope of the invention should be determined by the appended claims and their legal equivalence.

I claim:

1. A method of illuminating an outer garment, the method comprising steps of:

obtaining an illuminating undergarment, said illuminating undergarment comprising:

an undergarment body tailored of a fabric, said undergarment body having an undergarment material extending between an upper opening and at least one lower opening, an orientation of said undergarment body defining an exterior surface and an interior surface;

a plurality of illuminating device attachment elements affixed to said undergarment body;

obtaining at least one illuminating assembly comprising:

at least one illuminating element in electrical communication with a portable power supply;

attaching said at least one illuminating assembly to the undergarment body using a respective illuminating device attachment element of said plurality of illuminating device attachment elements;

placing said illuminating undergarment on an individual;

placing an outer garment on said individual, wherein said outer garment is sized and located covering said illuminating undergarment; and illuminating at least a portion of said at least one illuminating element causing light to be emitted therefrom, wherein said emitted light from each illuminated illuminating element is visible through fabric of said outer garment.

2. A method of illuminating an outer garment as recited in claim 1, the method further comprising a step of arranging said plurality of illuminating elements in a pattern.

3. A method of illuminating an outer garment as recited in claim 1, the method further comprising a step of arranging said plurality of illuminating elements in a pattern, wherein said pattern resembles an object.

4. A method of illuminating an outer garment as recited in claim 1, the method further comprising a step of arranging said plurality of illuminating elements in a pattern, wherein said pattern resembles text.

5. A method of illuminating an outer garment as recited in claim 1, the method further comprising a step of arranging said plurality of illuminating elements in a pattern, wherein said pattern resembles a combination of text and at least one object.

6. A method of illuminating an outer garment as recited in claim 1, wherein at least a portion of said plurality of illuminating device attachment elements is a pocket, wherein said at least one illuminating assembly further comprising an illuminating device housing, wherein said at least one illuminating element and said portable power supply are carried by said illuminating device housing, the method further comprising a step of:

placing each of said at least one illuminating assembly into a selected pocket of said plurality of illuminating device attachment elements.

7. A method of illuminating an outer garment as recited in claim 6, the method further comprising a step of arranging said plurality of illuminating elements in a pattern.

8. A method of illuminating an outer garment as recited in claim 1, wherein at least a portion of said plurality of illuminating device attachment elements further comprises a loop for receiving and temporarily assembling at least one of said at least one illuminating assembly to said undergarment body, wherein said at least one illuminating assembly further comprises an electrically conductive wire, and said at least one illuminating element further comprising a plurality of illuminating elements, wherein said electrically conductive wire carries each of said plurality of illuminating elements and provides electrical communication between each of said plurality of illuminating elements and said portable power supply, the method further comprising a step of:

using said loop to secure said at least one illuminating assembly to said undergarment body.

9. A method of illuminating an outer garment as recited in claim 8, the method further comprising a step of arranging said plurality of illuminating elements in a pattern.

10. A method of illuminating an outer garment as recited in claim 1, the method further comprising a step of providing a thermal barrier between each illuminating element of said plurality of illuminating elements and said undergarment body.

11. A method of illuminating an outer garment, the method comprising steps of:

obtaining an illuminating undergarment, said illuminating undergarment comprising:

an undergarment body tailored of a fabric, said undergarment body having an undergarment material extending between an upper opening and at least one lower opening, an orientation of said undergarment body defining an exterior surface and an interior surface, wherein the undergarment body is tailored to be one of:

a petticoat, a slip, an underskirt, an underdress comprising a bodice and a skirt, a blouse undergarment, a camisole undergarment, a tank top undergarment, a pant undergarment, a culottes undergarment, or a shorts undergarment;

a plurality of illuminating device attachment elements affixed to said undergarment body;

obtaining at least one illuminating assembly comprising:

at least one illuminating element in electrical communication with a portable power supply;

attaching said at least one illuminating assembly to the undergarment body using a respective illuminating device attachment element of said plurality of illuminating device attachment elements;

placing said illuminating undergarment on an individual;

placing an outer garment on said individual, wherein said outer garment is sized and located covering said illuminating undergarment; and illuminating at least a portion of said at least one illuminating element causing light to be emitted therefrom, wherein said emitted light from each illuminated illuminating element is visible through fabric of said outer garment.

12. A method of illuminating an outer garment as recited in claim 11, the method further comprising a step of arranging said plurality of illuminating elements in a pattern.

13. A method of illuminating an outer garment as recited in claim 11, the method further comprising a step of arranging said plurality of illuminating elements in a pattern, wherein said pattern resembles at least one of an object and text.

14. A method of illuminating an outer garment as recited in claim 11, wherein at least a portion of said plurality of illuminating device attachment elements is a pocket, wherein said at least one illuminating assembly further comprising an illuminating device housing, wherein said at least one illuminating element and said portable power supply are carried by said illuminating device housing, the method further comprising a step of:

placing each of said at least one illuminating assembly into a selected pocket of said plurality of illuminating device attachment elements.

15. A method of illuminating an outer garment as recited in claim 14, the method further comprising a step of arranging said plurality of illuminating elements in a pattern.

16. A method of illuminating an outer garment as recited in claim 11, wherein at least a portion of said plurality of illuminating device attachment elements further comprises a loop for receiving and temporarily assembling at least one of said at least one illuminating assembly to said undergarment body, wherein said at least one illuminating assembly further comprises an electrically conductive wire, and said at least one illuminating element further comprising a plurality of illuminating elements, wherein said electrically conductive wire carries each of said plurality of illuminating elements and provides electrical communication between each of said plurality of illuminating elements and said portable power supply, the method further comprising a step of:

using said loop to secure said at least one illuminating assembly to said undergarment body.

17. A method of illuminating an outer garment as recited in claim 16, the method further comprising a step of arranging said plurality of illuminating elements in a pattern.

18. A method of illuminating an outer garment, the method comprising steps of:

obtaining an illuminating undergarment, said illuminating undergarment comprising:

an undergarment body tailored of a fabric, said undergarment body having an undergarment material extending between an upper opening and at least one lower opening, an orientation of said undergarment body defining an exterior surface and an interior surface;

a plurality of illuminating device attachment elements affixed to said undergarment body, wherein said illuminating device attachment elements are at least one of:

a pocket, a strap, a strap formed into a loop, a strap formed into a loop secured by a fastener, a strap formed into a loop secured by a snap, a spring, a flexible wire, a snap, and a ribbon;

obtaining at least one illuminating assembly comprising: at least one illuminating element in electrical communication with a portable power supply;

attaching said at least one illuminating assembly to the undergarment body using a respective illuminating device attachment element of said plurality of illuminating device attachment elements;

placing said illuminating undergarment on an individual;

placing an outer garment on said individual, wherein said outer garment is sized and located covering said illuminating undergarment; and illuminating at least a portion of said at least one illuminating element causing light to be emitted therefrom, wherein said emitted light from each illuminated illuminating element is visible through fabric of said outer garment.

19. A method of illuminating an outer garment as recited in claim 18, the method further comprising a step of arranging said plurality of illuminating elements in a pattern.

20. A method of illuminating an outer garment as recited in claim 18, the method further comprising a step of arranging said plurality of illuminating elements in a pattern, wherein said pattern resembles at least one of an object and text.

* * * * *